US006176884B1

(12) United States Patent
Rizzardi

(10) Patent No.: US 6,176,884 B1
(45) Date of Patent: Jan. 23, 2001

(54) CONTINUOUS FABRIC RINSING METHOD AND APPARATUS

(76) Inventor: Angelo Rizzardi, 10507 Rougemont La., Charlotte, NC (US) 28277

( * ) Notice: Under 35 U.S.C. 154(b), the term of this patent shall be extended for 0 days.

(21) Appl. No.: 09/262,106

(22) Filed: Mar. 4, 1999

(51) Int. Cl.[7] ..... D06B 1/14

(52) U.S. Cl. ..... 8/149.1; 8/151; 68/202; 68/19.1; 68/148

(58) Field of Search ..... 68/202, 205 R, 68/158, 148, 19.1; 162/318, 323; 118/427, 405, 419, 428; 8/148, 151, 149.1

(56) References Cited

U.S. PATENT DOCUMENTS

| | | | | |
|---|---|---|---|---|
| 1,794,403 | * | 3/1931 | Hanhart | 68/158 |
| 2,826,057 | * | 3/1958 | Olson | 68/158 |
| 3,199,126 | * | 8/1965 | Chaikin et al. | 68/158 |
| 3,292,397 | * | 12/1966 | Wooliever | 68/158 |
| 3,465,552 | | 9/1969 | Okazaki . | |
| 3,663,160 | | 5/1972 | Stone et al. . | |
| 3,763,672 | | 10/1973 | Bahnsen . | |
| 3,774,419 | * | 11/1973 | Appenzeller | 68/158 |
| 3,828,589 | * | 8/1974 | Collinge | 68/158 |
| 3,950,802 | | 4/1976 | Schiffer et al. . | |
| 4,004,879 | | 1/1977 | Meier-Windhorst et al. . | |
| 4,020,658 | * | 5/1977 | Theis, Jr. | 68/158 |
| 4,033,152 | * | 7/1977 | Marchesini et al. | 68/202 |
| 4,050,270 | * | 9/1977 | Vecchia | 68/158 |
| 4,173,452 | * | 11/1979 | Fleissner | 8/151 |
| 4,182,140 | | 1/1980 | Sando et al. . | |
| 4,444,105 | * | 4/1984 | Mitter | 68/202 |
| 4,818,244 | | 4/1989 | Iwami . | |
| 5,493,744 | | 2/1996 | Beckstein et al. . | |
| 5,525,751 | * | 6/1996 | Niederkorn | 68/158 |

FOREIGN PATENT DOCUMENTS

| | | | | |
|---|---|---|---|---|
| 1113201 | * | 8/1961 | (DE) | 8/151 |
| 639742 | * | 6/1928 | (FR) | 68/158 |
| 981426 | * | 5/1951 | (FR) | 8/151 |
| 2075073 | | 11/1981 | (GB) . | |
| 38-19640 | | 9/1963 | (JP) . | |
| 197708 | | 8/1977 | (RU) . | |

* cited by examiner

*Primary Examiner*—Frankie L. Stinson
(74) *Attorney, Agent, or Firm*—Richard C. Litman

(57) ABSTRACT

A continuous fabric rinsing process and apparatus utilizing hot water applied in a rotating cylindrical rinsing roller device, for use in conventional steaming apparatus chambers where the preparation, dyeing and/or printing of fabric typically occurs. The fabric rinsing apparatus has an innermost perforated pipe along the longitudinal axis of the cylindrical rinsing roller that serves as a source of hot water which traverses rotating apertures present on the rinsing roller. The rinsing roller also contains external curvilinear rotor blades which propel the hot water outward through a rotating net cylinder, in order to clean a pretreated, dyed and/or printed fabric sheet continuously moving along an endless net belt. At least two steam injectors, appropriately located within the same steam chamber, are positioned in opposite directions in order to uniformly remove, by a steam-stream action, the undesirable contaminants, as well as partially dry the rinsed fabric sheet.

16 Claims, 5 Drawing Sheets

CONTINUOUS FABRIC RINSING METHOD AND APPARATUS

BACKGROUND OF THE INVENTION

1. Field of the Invention

The present invention relates generally to an improved apparatus and method for continuous rinsing with a minimum amount of boiling water and steam cleaning and substantial drying of flat or open width fabric material after the conventional preparation of, or dyeing or printing of, a mainly cellulosic or cellulosic blend cloth. More specifically, a series of innovative apparatus, i.e., roller rinsing devices, steam injector devices, and vacuum devices are employed in the steam chamber of the preceding preparation or dyeing or printing pad steam step.

2. Description of the Related Art

The related art of interest describes various apparatus and modes of washing fabric materials. The related art will be discussed in the order of perceived relevance to the present invention.

U.S. Pat. No. 3,663,160 issued on May 16, 1972, to Eric W. Stone et al. describes a method of processing solvent laden textile material, e.g., gray woven cotton cloth containing 100% by weight of trichloroethylene, perchloroethylene, 1,1,2-trichloro-1,2,2 -trifluoroethane or mixtures thereof, for the removal of grease and wax, by passing the cloth through a steam chamber for 3 to 6 seconds for at least 90% removal of the organic solvent, and subsequently washing in a hot water bath for 8–15 seconds. The method is distinguishable by the differences in the rinsing apparatus and the lack of the steam drying step and apparatus as shown in the present invention.

U.S. Pat. No. 3,763,672 issued on Oct. 9, 1973, to Erwin B. Bahnsen describes a continuous rinsing apparatus (syphon-surge rinser) for the application of a mist of gas and rinse liquid along a path normal to fabric articles containing solvent passing along a conveyor belt. Steam is applied from a plurality of manifolds through nozzles and through the passing fabric articles and the conveyor belt to be collected below by a plurality of collectors based on a gravity feed. The apparatus is distinguishable for its reliance only on the use of a series of steam ejectors directed downward on the passing articles and the condensing water being collected by gravity feed and not by a vacuum slot device and the use of a single rinsing roller device as in the present invention.

U.S. Pat. No. 4,182,140 issued on Jan. 8, 1980, to Yoshikazu Sando et al. describes an apparatus and method for cleaning a knitted tubular cloth. A series of hot water cleaning chambers are each immersed in a separate hot water collection tank. The cloth is fed into the collection tank and up to the top of the cleaning chamber to travel downward on a series of guide rolls having a series of guide rolls, wherein each guide roll having a draining washing dish. A hot water tank on top of the cleaning chamber adds more hot water on the passing cloth. Between each guide roll a fluttering and stretching roll is inserted. The tubular cloth enters the collection tank and traverses another series of rolls heated by steam jets. Steam jet pipes are also present above the collection tank. The cloth exits the collection tank and processed through squeezing rolls before passing into the next cleaning chamber. The apparatus and method are considered distinguishable for its reliance on a series of hot water cleaning chambers and water collection tanks utilizing a series of rolls and dishes as contrasted with the single rinsing roller of the present invention.

U.S. Pat. No. 3,465,552 issued on Sep. 9, 1969, to Narakazu Okazaki describes a cloth rinsing apparatus employing 6 to 8 pairs of eccentric or wing-like rollers operating within concave segmented walls inside a vertical water tank. The cloth is fed from above to the bottom of the tank and traverses upward through the beating rollers to a pair of squeeze rollers above the tank. Fresh water jets are fed from below the squeeze rollers and a fresh water reservoir is maintained above to contact the passing cloth. A series of these rinsing tanks can be used. The apparatus is distinguishable for its reliance on beating rollers which are not present in the present invention.

U.S. Pat. No. 3,950,802 issued on Apr. 20, 1976, to Gunter Schiffer et al. describes a process of continually washing a textile web in one or more closed pressurized vessels. The textile web is fed from the bottom of the vessel and up through two columns of guide rolls in a zig-zag manner. Each guide roll (except for the first and the last) has a perforated catch trough for the wash solution sprayed from the top of the vessel and drained out from the bottom. Steam or hot air inlet means are located at the top and bottom of the pressurized vessel at 100° C. and above 1 atm. pressure. The apparatus is distinguishable for its reliance on multiple guide rolls and catch troughs for washing the traversing textile web.

U.S. Pat. No. 4,004,879 issued on Jan. 25, 1977, to Christian A. Meier-Windhorst et al. describes a process for the wet treatment of traveling textile webs by soaking the webs with liquids, applying chemicals and dyes, and washing and rinsing in one vessel. The web is fed from the bottom of the vessel into a bath with heating coils. The web passes upward in a zig-zag manner between three columns of rollers, wherein the left column of rollers being supported with liquid collection shells into which various treatment solutions are fed to overflow downward. The middle column of rollers can be either a pair of squeezing rollers or stripping rollers. The right column rollers are reversing rollers with or without baffles to drain the liquid downward. Superheated steam at 110–115° C. is fed from the top of the vessel or recirculated by a compressor pump on top of the vessel. The apparatus is distinguishable by its requirement for multiple treatment rollers with dishes containing different liquids, an overflow tank and an exit tank containing chemicals or rinse water.

U.S. Pat. No. 4,818,244 issued on Apr. 4, 1989, to Hideo Iwami describes a cloth washing machine having a group of water tanks arranged in a steaming chamber supplied with saturated steam at 100° C. A series of guide rollers are arranged in two rows to conduct the cloth through a series of steam heated water tanks located underneath in a vertical zig-zag manner in order to alternately swell the cloth in steam, soak in water and exit through squeezing rollers. The passing cloth undergoes stretching and vibration forces applied in the machine. The apparatus is distinguishable for its alternate washing and steaming means as opposed to the single rotary rinser and double vacuum drying means of the present invention.

U.S. Pat. No. 5,493,744 issued on Feb. 27, 1996, to Helmut Beckstein et al. describes a method and apparatus for washing a width of textile fabric by utilizing a steam injector with a slit nozzle on the top surface of the transported fabric and a slit nozzle suction device positioned either directly below on the bottom surface of the fabric or displaced ahead with larger slit nozzles. The slit nozzle suction device having a nozzle width three times the width of the steam injector (now spaced from the fabric) has no overlap with the steam injector nozzle. The amount of the washing liquid entering the system is controlled by a regulation device having a testing device. A partial vacuum of at least 0.2 bar is applied on the wet fabric. The steam pressure is applied at a pressure at least 0.2 bar above atmospheric pressure. The openings of the nozzles are adjustable for treating different materials such as a thin fabric or a heavy carpeting. The apparatus and method described do not suggest the addition of a second steam injector and vacuum device and the reversal of positions as shown in the present invention.

Japanese Patent Publication No. 38-19640 published on Sep. 26, 1963, for British Nylon Spinners, Ltd. describes a textile material treating apparatus housing three chambers consisting of a first chamber containing delivery and winding rolls, a second diffusion chamber, and a larger steam chamber containing five rollers for transporting the textile. The apparatus is distinguishable for being limited to a steam chamber.

Russian Patent Publication No. 197,708 published on Aug. 25, 1977, describes a continuous pressure scouring and setting process with the introduction and removal of additional water. Treatment temperatures of 115–128° C. for a polyamide fabric and 135–145° C. for a polyester fabric are described. The scouring process does not describe specific apparatus.

U.K. Patent Publication No. 2 075 073 published on Nov. 11, 1981, for Yoshikazu Sando et al. describes textured guide rolls used in a pressure steamer for preventing the ironing effect of textiles caused by conventional rolls. The textured guide roll is not required in the present invention to reduce the ironing effect.

None of the above inventions and patents, taken either singularly or in combination, is seen to describe the instant invention as claimed. Thus, a continuous fabric rinsing apparatus solving the aforementioned problems is desired.

SUMMARY OF THE INVENTION

The present invention is an apparatus and method for continuous fabric rinsing and substantial drying performed after the conventional pad-steaming steps for: (1) preparation (desizing, scouring and bleaching) of the fabric; (2) dyeing the fabric; and (3) printing the fabric. The sundry chemicals utilized for pre-treating cellulosic fabrics such as cotton and their blends with synthetic fibers such as polyesters can be a caustic agent, peroxides, silicates, chelating agents, wetting agents, peroxide-stabilizing agents, scouring agents, emulsifying agents, and the like conventionally used in the industry for producing white cloth and the preparation for dyeing and printing of the aforementioned fabric materials.

The innovative rinsing apparatus and method are preferably included or housed within the same conventional steaming apparatus in which the preceding pad steam preparation, the pad steam dyeing and the pad steam printing step is carried out.

The invention is based on the following principles:

(a) The rinsing takes place in the steaming chamber where the above mentioned pad steam step is carried out and where the temperature is maintained at approximately 100° C. The temperature on the cloth does not drop when the fabric moves from the pad steam step to the following continuous rinsing operation housed in the same steamer. This temperature level provides the ideal conditions for the highest level of removal of most of the undesirable substances mentioned above.

(b) The steam-stream injector/vacuum slot device provides the best environment for maximizing the contact and the forceful passing of steam through the fabric. Therefore, this device allows the steam to perform as an ideal carrier for physically removing most of the undesirable substances kept at their best rinsable/removable conditions. The steam used in the steam-stream injector directly on the fabric should be saturated steam. Superheated steam can be used with allowance for its decompression and expansion before contact with the fabric.

(c) The new concept of the rinsing roller device using the principle of centrifuging a limited amount of boiling water out and through the fabric adds to the efficiency of the continuous rinsing process.

(d) The invention allows for a new level of full activation and performance of the chemicals applied on the fabric for the preparation purposes of desizing, scouring and bleaching.

(e) This new concept of the rinsing roller in combination with steam stream injector vacuum slot devices can, when used following a pad steam dyeing or printing step, maximize the removal of hydrolyzed and/or unfixed dyes and the chemicals used in combination with dyes. This will provide significant improvements of time, energy, water consumption and achieve higher levels of color fastness.

The present invention begins with a rotating cylindrical roller device in a steaming and rinsing chamber which utilizes boiling water from an innermost perforated pipe along the longitudinal axis of the rinsing roller device. The boiling water traverses a rotating and perforated cylinder having external curvilinear rotor blades which propel the boiling water outward through a rotating net cylinder to contact and clean the contiguous dyed fabric sheet being fed by a continuously moving endless net belt under the roller in a tank. The rinsing roller is covered on its top portion and the rinse water collects in a tank.

At least two slotted steam injectors placed downstream (but in opposite directions) clean the passing fabric, leaving a moisture content of approximately 5–20 wt. % by collecting the effluent with a vacuum slot element from each slotted steam injector. The efficiency of this system is improved by the addition of fabric width sensors which predetermine the applied width of the steam stream commensurate with the passing width of the fabric. The rinsed and partially dry fabric having a flat or open width form thus leaves the rinsing chamber devoid of undesirable contaminants and the like.

An alternative design for the rinsing roller includes an inner rotating net cylinder with directional ducts rotating at a greater speed than the rotor blades. An outer net cylinder rotates at a slower speed which matches the speed of the traveling fabric sheet below the rinsing roller.

Accordingly, it is a principal object of the invention to provide a continuous fabric rinsing apparatus housed in the steaming chamber of the preceding pad steam operation (preparation or dyeing or printing) and including downstream at least one rinsing roller device and at least a pair of opposed steam injector devices with vacuum slots and fabric width sensors for removing impurities from the rinsed fabric.

It is another object of the invention to provide a continuous fabric rinsing apparatus containing at least one novel rinsing roller device.

It is a further object of the invention is to provide a novel rinsing roller device employing a rotating net cylinder with directional struts, an endless net belt and rotating rotor blades.

Still another object of the invention is to provide a hot water pipe within the rinsing roller device having directional vanes patterned like a fish bone with sets of vanes directed in opposite directions to avoid creases in the passing fabric.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to an improved continuous fabric rinsing apparatus including two alternative steam injector/vacuum slot devices as demonstrated in FIGS. 1–5.

Figure 1:
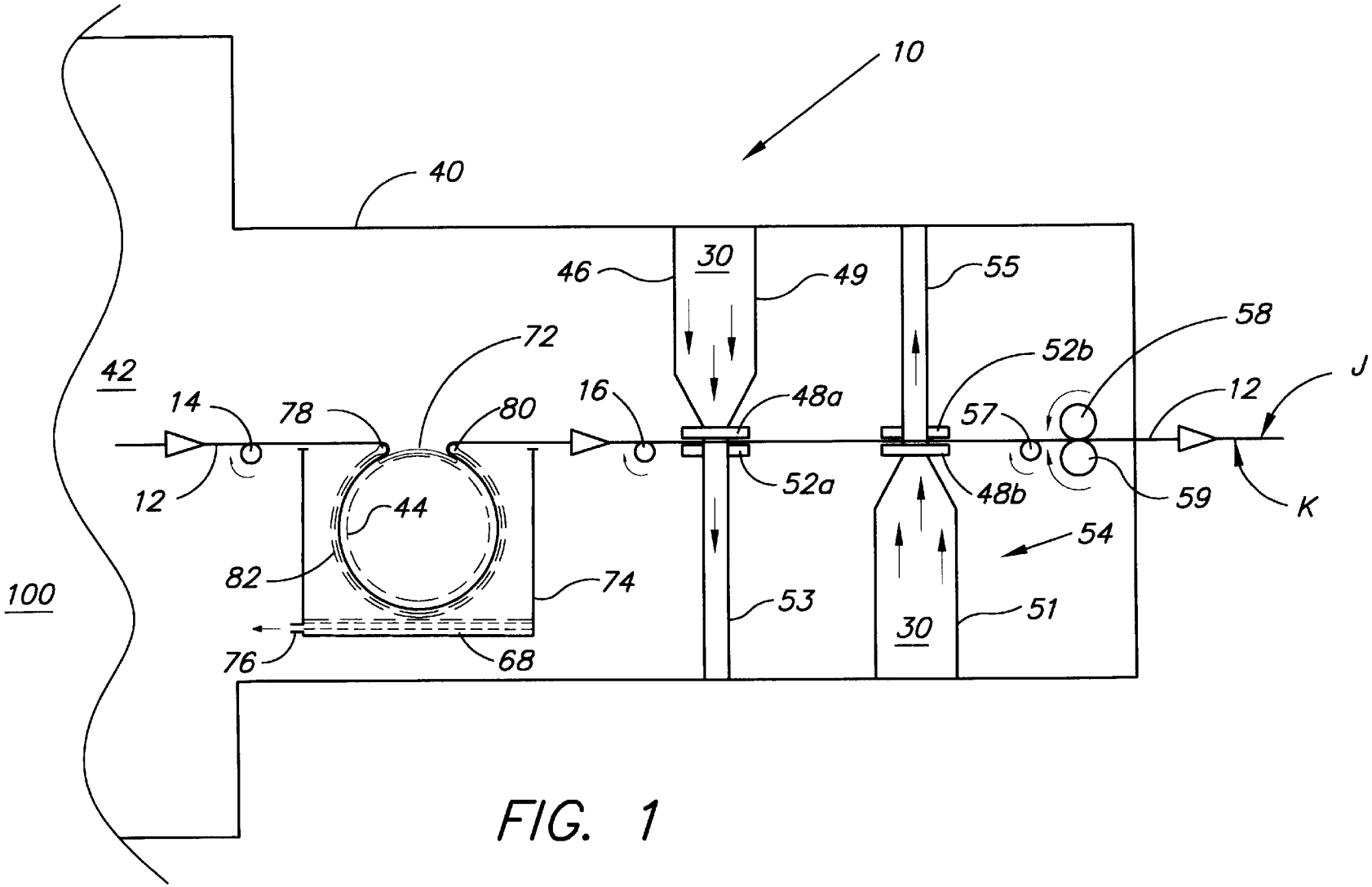
FIG. 1 is a schematic view of a rinsing roller and steam rinsing operation for fabrics according to the present invention.

In FIG. 1, the continuous processing apparatus 10 begins with a fabric 12 (also referred to as cloth) preferably having a flat or open width, having been previously fed through any type of currently available or conventionally known steam apparatus 100 used for preparing, dying and/or printing fabric, and that typically comprises the cloth 12 going through squeezing rollers following a chemical or dye saturation step and into the steam chamber through an entry slot. Steam is introduced into the chamber to steam the fabric 12. Any type of currently available steamer equipment or system can be used. The steamed fabric 12 is then fed into the rinsing chamber 40 of the present invention through an entrance region 42 at spreading roller 14, and into the water receiving tank 74 between an entry roller 78 and a solid cover 72 and onto an endless net belt 82. The steamed fabric 12, having a top side J and a bottom side K, then proceeds along the endless net belt 82 to a rinsing roller or cylinder device 44 where the fabric 12 has a first rinse with hot water 68. The fabric 12 then exits the water receiving tank 74 and the endless net belt 82 between an exit roller 80 and the solid cover 72, and travels along a spreading roller 16 to the steam injectors.

Figure 5:
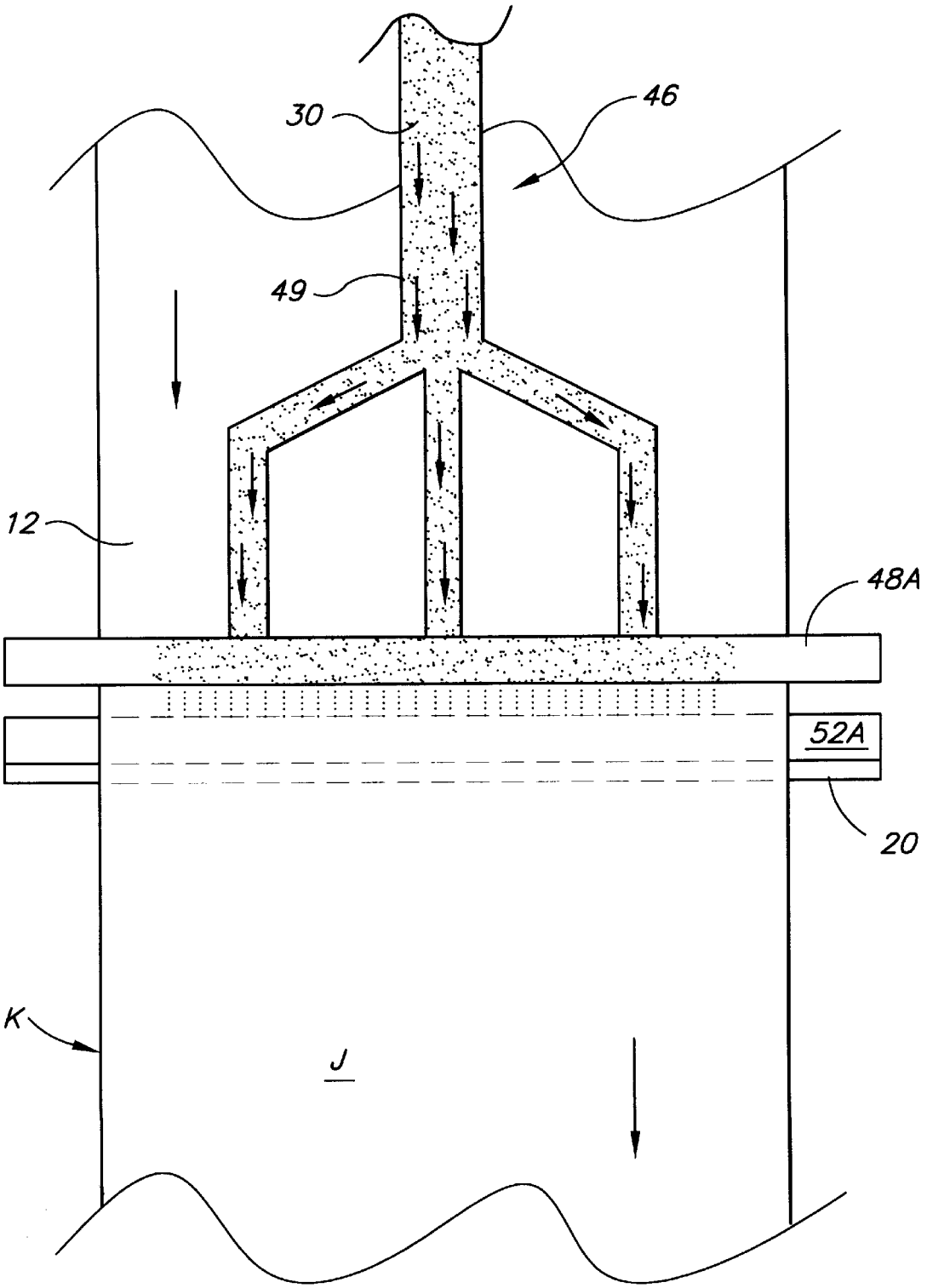
FIG. 5 is a front elevational, schematic view of one steam injector according to the instant invention.

As depicted in FIGS. 1 and 5, the fabric 12 passes on to the first steam injector and vacuum slot stage 46 where a first steam injector 49 is positioned to inject a steam 30 jet downward through a perforated steam pipe 48*a* and through the top side J of fabric 12. The steam that travels through the fabric 12 is then received by a vacuum slotted pipe portion 52*a* and removed by a first vacuum pipe 53 (as shown in FIG. 1). As depicted in FIG. 1, a second steam injector and vacuum slot stage 54 receives the fabric 12 for further processing by injecting another steam 30 jet upward through a second steam injector 51 into a perforated steam pipe 48*b*, then through the bottom side K of the fabric 12. The steam that travels through the fabric 12 is then received by a vacuum slotted pipe portion 52*b* and removed by a second vacuum pipe 55. The vacuum slotted pipe portions (52*a*, 52*b*) also preferably contain a fabric width sensor 20, as generally depicted in FIG. 5, which senses the actual width of the extended fabric 12 to adequately apportion the steam jets 30 in order to match the width of the fabric. The fabric 12, upon leaving the steam injectors, travels over the spreading roller 57, then through squeezing rollers (58,59).

It should be noted that the steam injector pipes 49 and 51 can have a variety of structures, such as an elongated single pipe or a manifold structure commensurate in width with the extended fabric 12, a series of separate pipes, or a preferred embodiment as demonstrated in FIG. 5 wherein the steam injector pipes are a series of connected branched pipes. While the distances between the various elements of the current invention can vary, each element (e.g. steam and vacuum pressure) should be arranged in order to allow for the proper and adequate steam cleaning of the fabric traveling through the rinsing chamber.

Figure 2:
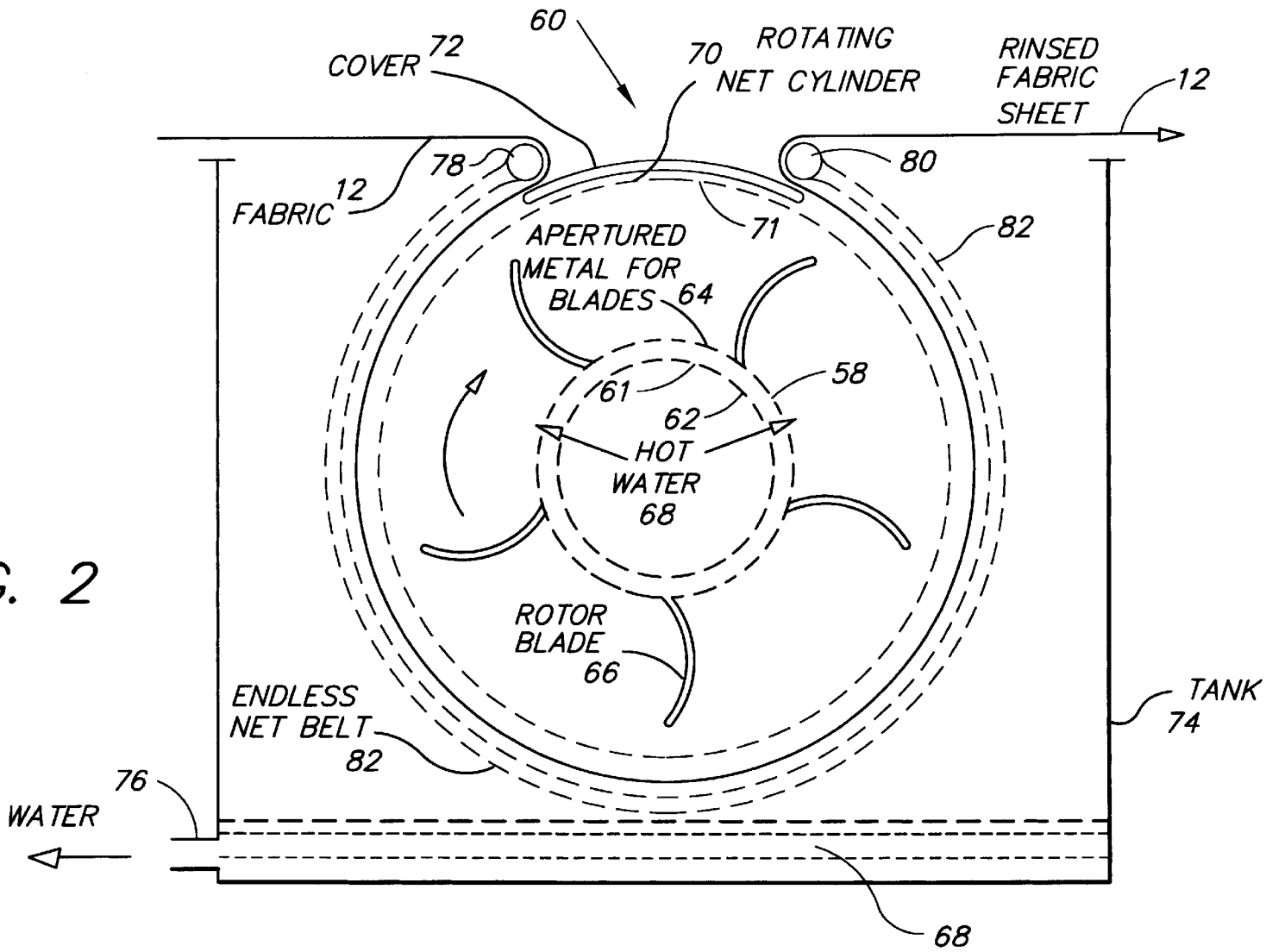
FIG. 2 is a schematic, elevational side view of a first embodiment of a rinser roller device.

In FIG. 2, a first embodiment of a rinsing roller device 60 is depicted. An elongated hot water pipe 62, having apertures or perforations 61, is centered within a rotating metal cylinder 64, having apertures or perforations 58, to which are affixed, preferably five curved rotor blades 66 (the number of blades being exemplary), to direct the hot water 68 outward under additional centrifugal force. A freely rotating and surrounding net cylinder 70, having perforations or apertures 71, rotates around and in the same direction as the metal cylinder 64 and the blades 66, and at a rotation rate preferably equal to the fabric speed. The fabric speed being the speed at which the fabric is traveling through the rinsing chamber 40, and the rotation speed of the cylinder 64 is preferably much higher than the rotation speed of the net cylinder 70.

A solid cover 72 on a top portion prevents loss of water. A water receiving tank 74 collects the draining water which leaves through the drain pipe 76 at the bottom of the tank. The steamed fabric sheet 12 enters the rinsing roller device 60 over an entry roller 78, and exits over an exit roller 80 as a partially rinsed fabric sheet. The rollers 78 and 80 additionally rotate an endless net belt 82, at the same speed or at a slightly lower speed than the speed of the net cylinder 70, underneath the fabric sheet 12 being rinsed, for the purpose of containing the fabric sheet, and preventing any frictional contact between the moving fabric sheet 12 with the net cylinder 70.

Figure 3:
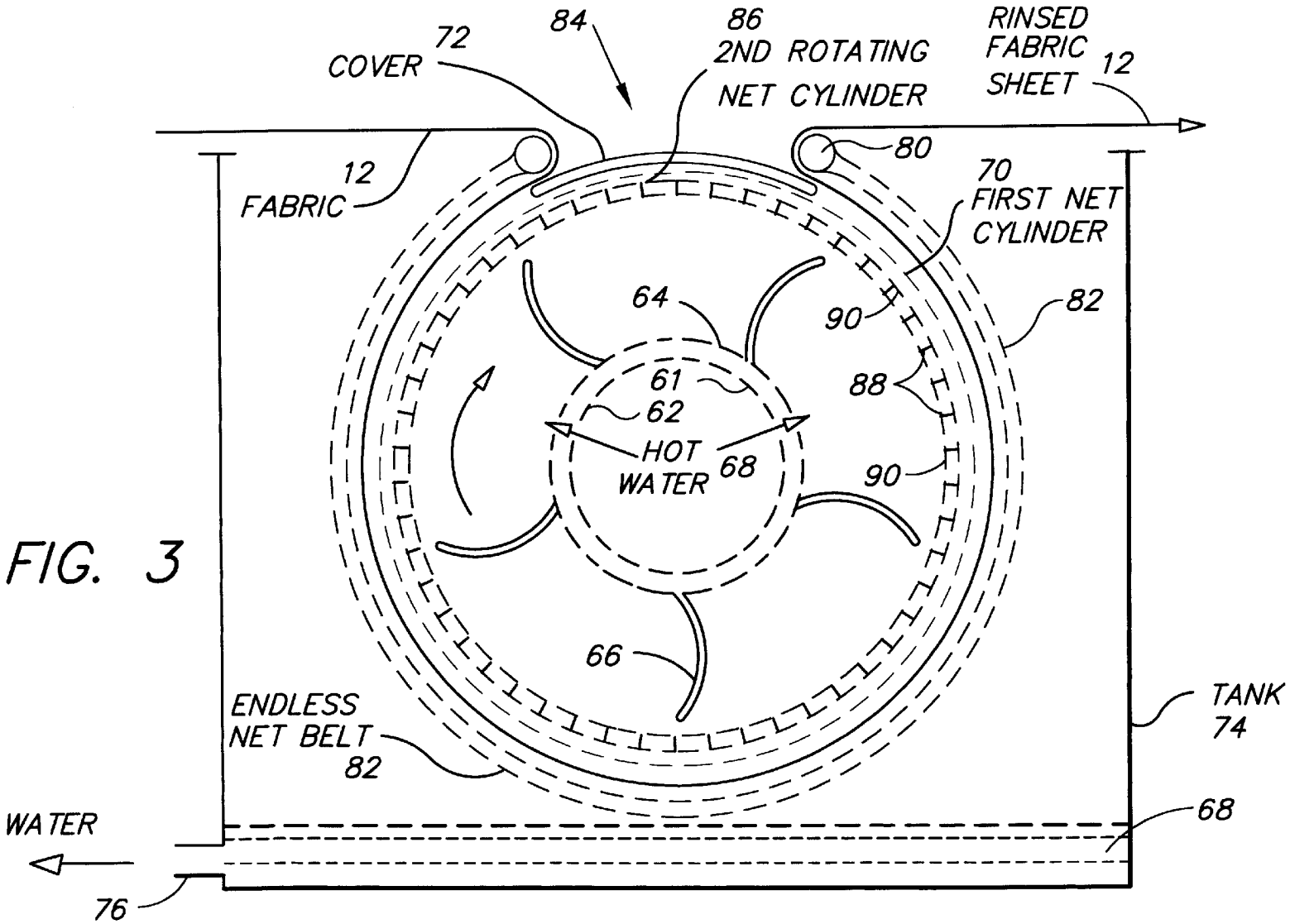
FIG. 3 is a schematic, elevational side view of a second embodiment of a rinser roller device.
Figure 4:
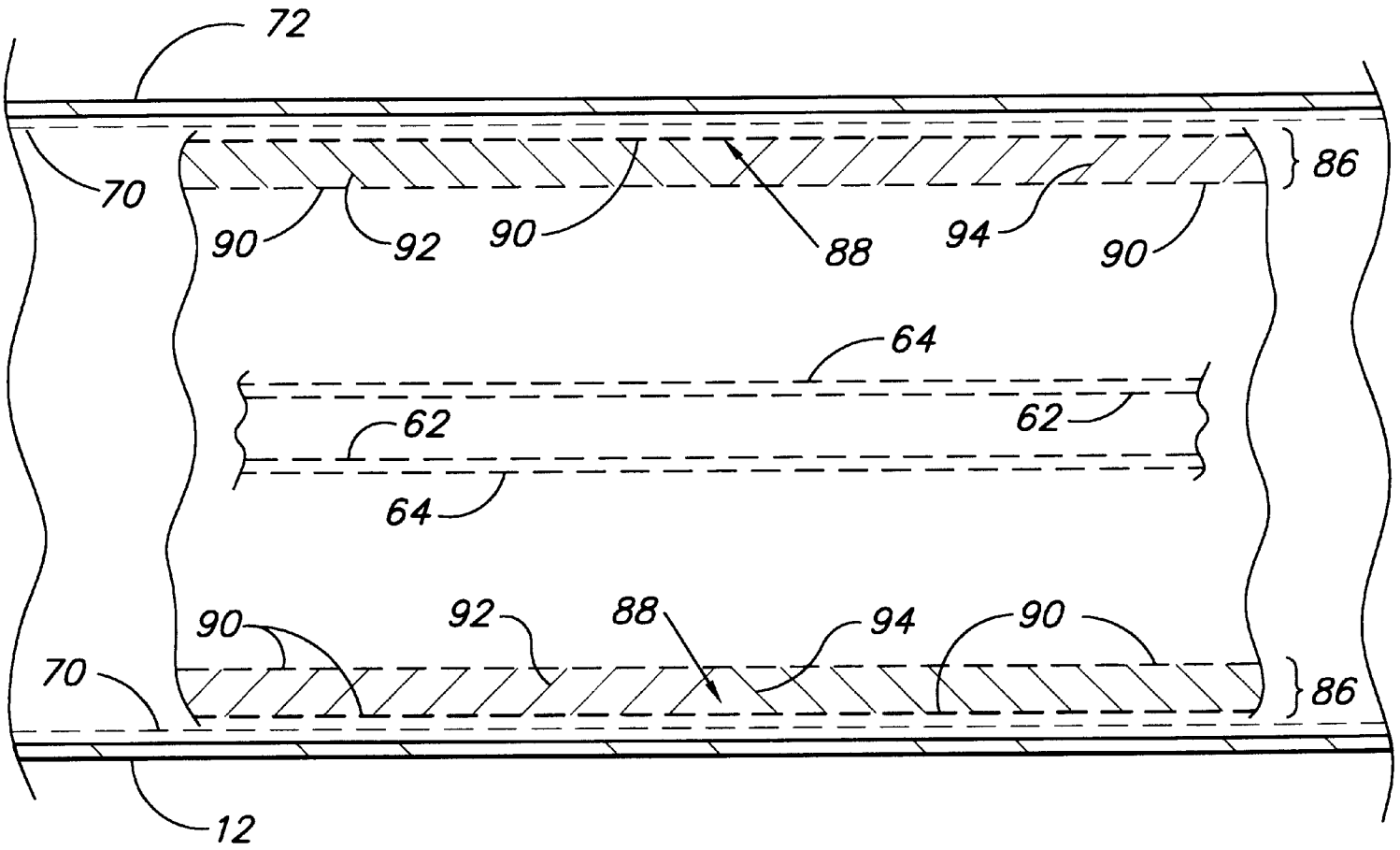
FIG. 4 is a cross-sectional view of the rotating net cylinder with internal fish-bone like directional struts or vanes.

FIG. 3 illustrates a second embodiment of the invention that differs from the first embodiment in that the rinsing roller device 84 further contains a double walled or second net rotating cylinder 86 having multiple directional vanes or struts 88 integrally attached between the perforated walls 90, and arranged in a fish bone-like geometry or pattern (as depicted in FIG. 4) to better direct the hot water 68 through the rotating outer net cylinder 70 and the fabric sheet 12 towards the edges of the fabric sheet to avoid any creasing by flattening the fabric. The diameters of the hot water pipes 62 in the schematic drawings of FIGS. 2 and 3 and their relative proximity to the rotating apertures cylinders 64 and 86 are considered parameters determinable within the skill of one in the art, however it is preferable to minimize the distance between them. In an alternative embodiment, not shown in FIG. 3, cylinders 64 and 86 can be combined into one cylinder. The rotating cylinders can be dependently or independently driven.

FIG. 4 illustrates schematically, in cross-section, the fish bone-like geometric structure or pattern of an alternative embodiment of struts, collectively referred to in this embodiment as struts 88 in the double walled net cylinder 86 located inside independently rotating net cylinder 70. FIG. 4 also illustrates, in cross section, the cover 72, the fabric 12, the apertured rotating metal cylinder 64 and the apertured hot water pipe 62, however, the rotor blades 66 are not shown due to the cross sectional view shown in FIG. 4. The net cylinder 86 shows the fish-bone construction of the collective group of struts 88 formed integrally between the walls 90. The collective group of struts consists preferably of struts 92 located on one side, that direct water in an outward direction, opposite the direction than the water deflected from the struts 94 located on the opposite side of struts 92. Thus, hot water can be propelled in different directions towards the fabric being rinsed from different angles to more effectively rinse the fabric free of impurities and to flatten the fabric for prevention of creases, particularly when the rotation speed of apertured metal cylinder 64 and net cylinder 86 is preferably considerably higher than the rotation speed of cylinder 70.

It is within the ambit of the present invention to locate the rinsing roller elements of FIGS. 1–4 either before or in-between the steam injector/vacuum slot devices, or at the exiting end, as well as increase the number of rinsing roller elements and the steam injector/vacuum slot devices.

The present invention conserves the use of large quantities of water conventionally required in the present fabric rinsing apparatus and equipment which utilizes a long train of rinsing chambers, placed outside the steamer equipment where the preceding pad steam operation (preparation and/or drying and/or printing) is carried out. The present invention, even if not housed in the same steamer than the one used in pad steamer preparation and/or drying and/or printed step, while offering less advantages than those described above, will still present a significant improvement over currently utilized continuous vertical or horizontal fabric rinsing operations.

It is to be understood that the present invention is not limited to the embodiments described above, but encompasses any and all embodiments within the scope of the following claims.

I claim:

1. A rinsing roller apparatus for continuously removing impurities from a traveling wet fabric sheet having an extended width comprising:

a liquid collection tank having a forward end, a rear end and a bottom with a drain proximate the bottom;

a partial circular cover over said tank;

a pair of elongated rollers inside and proximate said forward end and said rear end, respectively, of said tank;

an endless net belt traversing said pair of elongated rollers and commensurate in width to the width of a traveling fabric;

an elongated perforated central pipe adapted to disperse hot water;

a perforated cylinder adapted to rotate in said one direction, and surrounding said central pipe and having affixed thereon a plurality of curved rotor blades; and a perforated net cylinder adapted to rotate in said one direction, and surrounding said perforated cylinder with said rotor blades;

at least one elongated steam jet and vacuum slot device downstream from said collection tank for cleaning and at least partially drying the wet fabric sheet across its entire extended width;

a rinsing chamber enclosing said collection tank and said at least one elongated steam jet and vacuum slot device;

sensors in said at least one vacuum slot device for detecting the width of the wet fabric sheet and enabling an automatic adjustment of the vacuuming width of said at least one vacuum slot device;

whereby the traveling wet fabric sheet is treated to remove residual impurities by passing said hot water centrifugally through said rotating net cylinder and the traveling wet fabric sheet.

2. The rinsing roller apparatus according to claim 1, including a net cylinder with two walls having a plurality of internal struts equidistantly spaced between and integral with the walls, and adapted to direct said hot water outward from said rotor blades to said traveling wet fabric sheet.

3. The rinsing roller apparatus according to claim 1, wherein said at least one elongated steam jet and vacuum slot device includes two steam jet and vacuum slot devices positioned oppositely from each other, with one said device positioned downstream from the other device.

4. The rinsing roller apparatus according to claim 1, wherein said steam is one of superheated steam and saturated steam.

5. A continuous fabric rinsing apparatus for treating a traveling wet fabric sheet having an extended width comprising:

an elongated rinsing chamber which accepts a wet fabric sheet having an extended width at one end and ejects an at least partially dry rinsed fabric sheet at an opposite end;

a rinsing roller apparatus comprising:

a liquid collection tank having a forward end, a rear end and a bottom with a drain proximate its bottom;

a partial circular cover over said tank;

a pair of elongated rollers inside and proximate said forward end and said rear end, respectively, of said tank;

an endless net belt traversing said pair of elongated rollers and commensurate in width to the width of a traveling fabric;

an elongated perforated central pipe adapted to rotate in one direction for dispersing hot water;

a perforated cylinder adapted to rotate in said one direction and having affixed thereto externally a plurality of curved rotor blades, and said perforated cylinder surrounding said central pipe; and a perforated net cylinder adapted to rotate in said one direction, and surrounding said perforated cylinder with said rotor blades;

whereby the wet fabric sheet traveling through said rinsing chamber is treated to remove residual impurities by passing said hot water through said rotating net cylinder and the traveling wet fabric sheet.

6. The rinsing roller apparatus according to claim 5, including a net cylinder with two walls having a plurality of internal struts equidistantly spaced between and integral with the walls, and adapted to direct said hot water outward from said rotor blades to said traveling wet fabric sheet.

7. The continuous fabric rinsing apparatus according to claim 5, including an elongated steam jet and a vacuum slot device downstream from said rinsing roller for incremental cleaning and at least partially drying the wet fabric sheet across its entire extended width.

8. The continuous fabric rinsing apparatus according to claim 7, including sensors in said vacuum slot device for detecting the width of the wet fabric sheet for automatic adjustment of the vacuuming width of said vacuum slot device.

9. The continuous fabric rinsing apparatus according to claim 8, including two steam jet and vacuum slot devices being positioned opposite from each other, with one said device being positioned downstream from the other device.

10. The continuous fabric rinsing apparatus according to claim 7, wherein said steam jet is one of superheated steam and saturated steam.

11. A continuous fabric rinsing process for removing impurities from a traveling wet fabric sheet comprising:

passing a wet fabric sheet having an extended width through an elongated steaming and rinsing chamber which accepts the wet fabric sheet at one end and ejects a partially dry rinsed fabric sheet devoid of impurities at an opposite end;

rinsing the wet fabric sheet by passing the fabric through a rinsing roller apparatus in which hot water issues from a centered perforated pipe to be propelled by rotor blades centrifugally outward through a first double walled perforated net cylinder and a second perforated net cylinder to the fabric sheet, the first double walled cylinder having a plurality of equidistantly spaced apart internal struts, the first double walled net cylinder and the second net cylinder adapted to rotate in one direction with the double walled net cylinder having an adjustably higher rotation speed for increasing the velocity of the hot water through the perforated net cylinder to the fabric sheet; and guiding the wet fabric sheet along by an endless net belt positioned below the rinsing roller apparatus;

whereby residual impurities are removed from the fabric sheet in the rinsing roller apparatus.

12. The process according to claim 11, including an incremental cleaning action also performing a partial steam drying step after said rinsing step by applying a steam jet on one side of the wet fabric sheet and applying a vacuum on an opposite side of the wet fabric sheet.

13. The process according to claim 12, including the detection of the width of the fabric sheet passing by a plurality of sensors in the vacuum slot device, enabling automatic adjustment of the vacuuming width of the vacuum slot device.

14. The process according to claim 12, wherein said incremental cleaning action also performing a partial steam drying step includes another steaming and vacuuming step downstream from an opposite direction.

15. The process according to claim 12, wherein the steam jet is selected from the group consisting of superheated steam and saturated steam.

16. A process for the continuous rinsing of a wet fabric sheet having an extended width in a steam chamber comprising:

providing an elongated steaming and rinsing chamber which accepts a wet fabric sheet having an extended width at one end and ejects a partially dry rinsed fabric sheet at an opposite end;

providing a rinsing roller apparatus comprising:

a liquid collection tank having a forward end, a rear end and a bottom with a drain proximate the bottom;

a partial circular cover over the tank;

a pair of elongated rollers inside and proximate the forward end and the rear end, respectively, of the tank;

an elongated perforated central pipe dispersing hot water centrifugally;

a perforated cylinder having affixed a plurality of curved rotor blades, adapted to rotate in one direction, and surrounding said central, pipe;

a perforated net cylinder adapted to rotate in said one direction, and surrounding the perforated cylinder with the rotor blades; and an endless net belt traversing the pair of elongated rollers below the perforated net cylinder and commensurate in width to the width of a traveling fabric;

whereby the wet fabric sheet traveling through the steaming and rinsing chamber is treated to remove residual impurities in the rinsing roller apparatus by passing the hot water through the rotating net cylinder and the traveling wet fabric sheet.

* * * * *